US009442440B2

(12) United States Patent
Hashiguchi et al.

(10) Patent No.: US 9,442,440 B2
(45) Date of Patent: Sep. 13, 2016

(54) FIXING DEVICE AND IMAGE FORMING APPARATUS

(71) Applicant: CANON KABUSHIKI KAISHA, Tokyo (JP)

(72) Inventors: Shinji Hashiguchi, Mishima (JP); Masahide Hirai, Numazu (JP); Kentaro Yamashita, Suntou-gun (JP); Aoji Isono, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/804,548

(22) Filed: Jul. 21, 2015

(65) Prior Publication Data

US 2016/0026123 A1 Jan. 28, 2016

(30) Foreign Application Priority Data

Jul. 22, 2014 (JP) ..... 2014-148611

(51) Int. Cl.
*G03G 15/20* (2006.01)

(52) U.S. Cl.
CPC .. *G03G 15/2053* (2013.01); *G03G 2215/2035* (2013.01)

(58) Field of Classification Search
USPC ..... 399/67
See application file for complete search history.

(56) References Cited

U.S. PATENT DOCUMENTS 7,190,914 B2 3/2007 Nihonyanagi et al.
7,215,899 B2 5/2007 Kimizuka et al.
7,251,447 B2 7/2007 Kanamori et al.
7,280,775 B2 10/2007 Kubochi et al.
7,518,089 B2 4/2009 Hashiguchi et al.
8,068,757 B2 11/2011 Hashiguchi
8,112,024 B2 2/2012 Saito et al.

(Continued)

FOREIGN PATENT DOCUMENTS

JP S51-120451 10/1976
JP 2005-99238 4/2005
JP 2005-100699 4/2005
JP 2008-116631 5/2008

OTHER PUBLICATIONS

U.S. Appl. No. 14/802,159 to Masahide Hirai, filed one Jul. 17, 2015.

*Primary Examiner* — Clayton E Laballe
*Assistant Examiner* — Warren K Fenwick
(74) *Attorney, Agent, or Firm* — Fitzpatrick, Cella, Harper & Scinto

(57) ABSTRACT

A fixing device fixes an image on a sheet, and includes a rotatable member having an electroconductive layer; a helical coil provided inside the rotatable member and having a helix axis extending in a generatrix direction of the rotatable member; a magnetic member provided inside a helical configuration portion formed by the coil, the magnetic member not forming a loop outside the rotatable member; and a controller for controlling electric power supplied to the coil. The electroconductive layer generates heat by electromagnetic induction caused by the magnetic flux produced by an alternating current through the coil to fix the image on the sheet by the heat from the rotatable member. The controller limits the maximum electric power supplied to the coil, in accordance with the temperature of the magnetic member.

10 Claims, 7 Drawing Sheets

(56) References Cited

U.S. PATENT DOCUMENTS

| | | | | |
|---|---|---|---|---|
| 8,265,507 | B2 | 9/2012 | Saito et al. | |
| 8,472,826 | B2 | 6/2013 | Hashiguchi | |
| 8,755,705 | B2 | 6/2014 | Nakahara et al. | |
| 9,091,974 | B2 | 7/2015 | Yoshioka et al. | |
| 2014/0161498 | A1 | 6/2014 | Hashiguchi et al. | |
| 2015/0168880 | A1* | 6/2015 | Jota | G03G 15/2053 399/333 |
| 2015/0168892 | A1* | 6/2015 | Kuroda | G03G 15/2053 399/329 |
| 2015/0268602 | A1 | 9/2015 | Yoshioka et al. | |

* cited by examiner (a)

(b)

FIXING DEVICE AND IMAGE FORMING APPARATUS

FIELD OF THE INVENTION AND RELATED ART

The present invention relates to a fixing device which uses a heating method based on electromagnetic induction, and an image forming apparatus equipped with a fixing device which uses a heating method based on electromagnetic induction.

Generally speaking, a fixing device to be mounted in an image forming apparatus such as an electrophotographic printer and an electrophotographic printer is provided with a rotational heating member and a pressure roller which is kept pressed upon the heating member. It is configured to fix an unfixed toner image on a sheet of a recording medium by heating the unfixed toner image and sheet while conveying the sheet through the nip, which the heating member and pressure roller form between them.

In recent years, there has been proposed a fixing device which uses a heating method based on electromagnetic induction. This type of fixing device is capable of generating heat directly in its rotational heating member, being therefore shorter in warm-up time than the other types of fixing devices. It has also such a merit that it consumes less electric power than the other types of fixing devices.

There is disclosed in Japanese Laid-open Patent Application S51-120451, a fixing device which is provided with a magnetic circuit having an internal space through which an alternating magnetic flux passes, and a cylindrical member which is formed of an electrically conductive substance and which is disposed in the internal space of the magnetic circuit. The fixing device is configured so that the cylindrical member is heated by the electric current induced in the cylindrical member and the electrical resistance of the cylindrical member. In the case of this fixing device, the cylindrical member itself functions as a heater. Therefore, it has such a merit that it is simple in structure, and yet, high is thermal efficiency.

Also in recent years, it has been desired to reduce the aforementioned rotational heating member in diameter, in order to reduce the size of the fixing device and to reduce the thermal capacity of the rotational heating member. One of the methods for achieving such an objective is to reduce in size the coil and core, which are disposed in the internal space of the rotational heating member. However, reducing the core in size makes it necessary to take into consideration the phenomenon that the core becomes saturated with magnetic flux.

As the core is saturated with magnetic flux, the inductance of the coil suddenly decreases. Consequently, a large amount of electric current flows through the coil, thereby damaging the electric power source. The core becomes saturated with magnetic flux as the amount of magnetic flux generated in the core reaches a specific value (point of saturation).

FIG. 10 shows the relationship between the size of the cross section (at plane perpendicular to direction of magnetic flux) and the magnetic flux saturation. As is evident from FIG. 10, the smaller the cross-sectional size of the core, the lower the point of its magnetic flux saturation. Further, the occurrence of the saturation of the core with magnetic flux is related to the core temperature; the higher the core temperature, the lower the point of magnetic flux saturation.

In the past, therefore, in order to prevent the problem that the magnetic flux is generated by an amount which is greater than the amount which is large enough to saturate the core with magnetic flux, it was necessary to limit (control) the amount of magnetic flux generated in the core. However, reducing the core in size to reduce the rotational heating member in size limits the amount of magnetic flux allowed to be generated. Thus, reducing the rotational heating member in size to reduce the rotational heating member in thermal capacity is not satisfactorily, because it increases the length of startup time of the heating device. In other words, it increases the the length of FPOP (First Print Out Time) of the fixing device.

SUMMARY OF THE INVENTION

According to an aspect of the present invention, there is provided a fixing device for fixing an image on a recording material. The fixing device comprises: a rotatable member having an electroconductive layer; a helical coil provided inside the rotatable member and having a helix axis extending in a generatrix direction of the rotatable member; a magnetic member provided inside a helical configuration portion formed by the coil, the magnetic member not forming a loop outside the rotatable member; and a controller for controlling electric power supplied to the coil. The electroconductive layer generates heat by electromagnetic induction caused by the magnetic flux produced by an alternating current through the coil to fix the image on the recording material by the heat from the rotatable member. The controller limits the maximum electric power supplied to the coil, in accordance with the temperature of the magnetic member.

Further features of the present invention will become apparent from the following description of exemplary embodiments with reference to the attached drawings.

Figure 11:
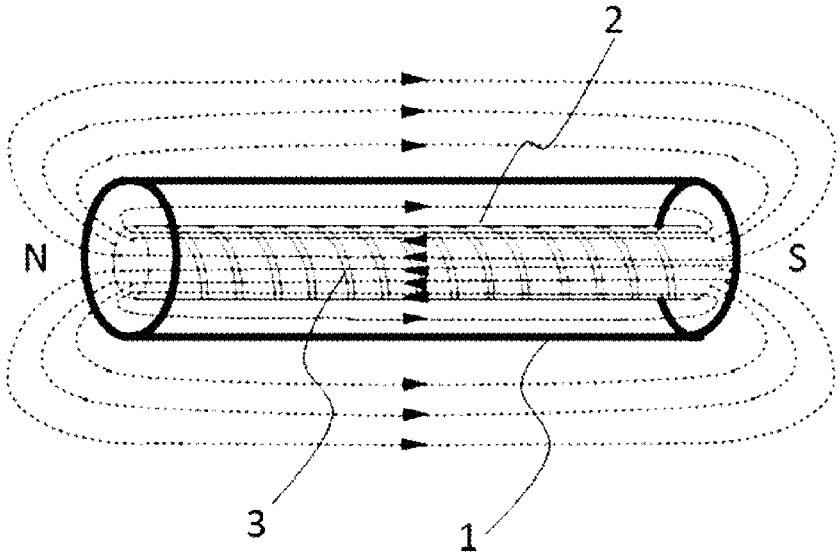
Figure 11:
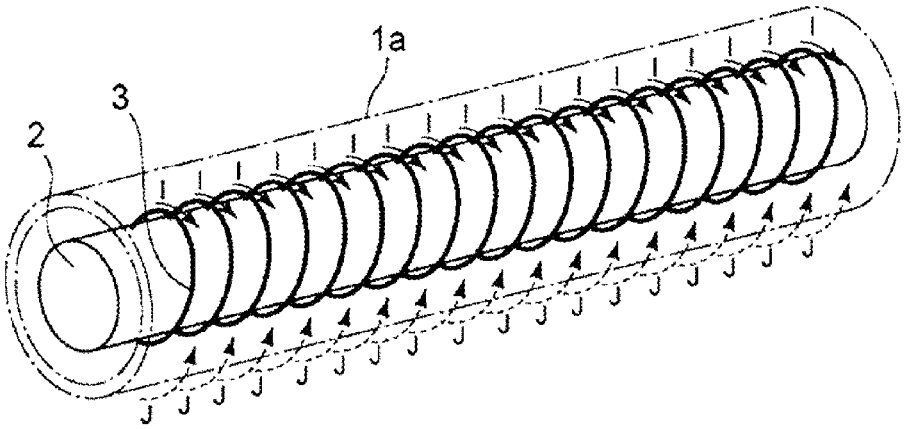

Parts (a) and (b) of FIG. 11 are schematic views illustrating the heat generation principle of the fixation sleeve.

DESCRIPTION OF THE EMBODIMENTS

[Embodiment 1]

1. General Description of Image Forming Apparatus Equipped with Fixing Device

Figure 1:
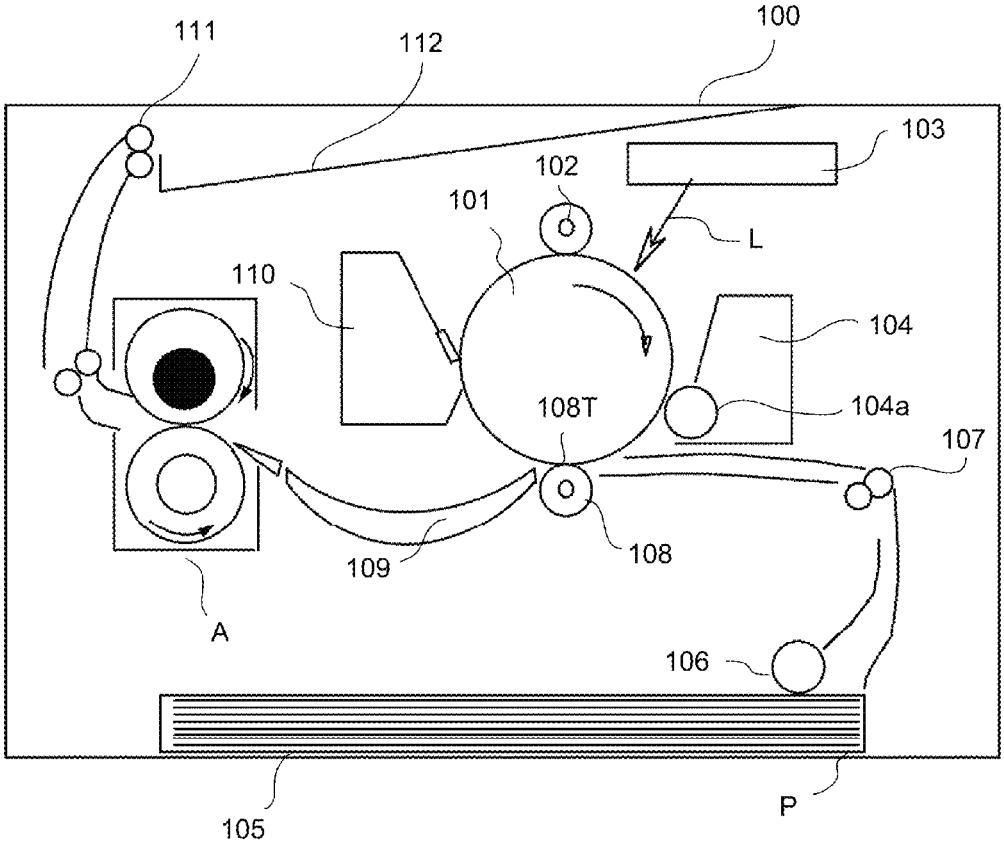
FIG. 1 is a schematic sectional view of a typical image forming apparatus to which the present invention is applicable, and shows the general structure of the apparatus.

FIG. 1 is a schematic sectional view of an image forming apparatus 100 equipped with a fixing device, in the first embodiment. It shows the general structure of the apparatus. The image forming apparatus 100 is a laser beam printer which uses an electrophotographic image forming method. A reference numeral 101 stands for a photosensitive drum as an image bearing member. It is rotationally driven in the clockwise direction indicated by an arrow mark at a preset process speed (peripheral velocity). As the photosensitive drum 101 is rotationally driven, it is uniformly charged by a charge roller 102 to a preset polarity and a preset potential level.

A reference numeral 103 stands for a laser beam scanner as an image exposing means. The scanner 103 scans (exposes) the charged peripheral surface of the photosensitive drum 101 with a beam L of laser light, which it outputs while modulating (turning on or off) the beam L with digital image formation signals which are inputted from an unshown external device, such as a computer, and are generated by an image processing means. Thus, the exposed points of the charged peripheral surface of the photosensitive drum 101 are discharged. Consequently, an electrostatic latent image, which reflects the image formation signals, is effected on the peripheral surface of the photosensitive drum 101.

A reference numeral 104 stands for a developing device, which has a development roller 104*a*, from which the peripheral surface of the photosensitive drum 101 is supplied with developer (toner). The electrostatic latent image on the peripheral surface of the photosensitive drum 101 is continuously developed by the developer on the peripheral surface of the photosensitive drum 101, starting from its downstream end in terms of the rotational direction of the photosensitive drum 101.

A reference numeral 105 stands for a sheet feeding cassette, in which multiple sheets of a recording medium are stored in layers. As the image forming apparatus 100 receives a signal for starting recording medium conveyance, a sheet feeding roller 106 is driven, whereby the sheets P in the sheet feeding cassette 105 are fed one by one by the sheet feeding roller 106 into the main assembly of the image forming apparatus 100 while being separated from the rest in the cassette 105. Then, each sheet P is sent to a pair of registration rollers 107, and then, is sent by the registration rollers 107 to an area 108T of transfer, which is the nip between the photosensitive drum 101, and a transfer roller 108 which is rotated in contact with the photosensitive drum 101 by the rotation of the photosensitive drum 101. That is, the conveyance of the sheet P is controlled by the pair of registration rollers 107 so that the leading edge of the image on the peripheral surface of the photosensitive drum 101, and the leading edge of the sheet P arrive at the area 108T of transfer at the same time.

Thereafter, the sheet P is conveyed through the area 108T of transfer while remaining pinched between the photosensitive drum 101 and transfer roller 108. While the sheet P is conveyed through the area 108T of transfer, a transfer voltage (transfer bias), which is kept stable in amplitude at a preset value, is applied to the transfer roller 108 from an unshown transfer bias application power source. More specifically, the transfer bias applied to the transfer roller 108 is opposite in polarity from the toner. Thus, the toner image on the peripheral surface of the photosensitive drum 101 is electrostatically transferred onto the surface of the sheet P, in the area 108T of transfer. After the transfer, the sheet P is separated from the peripheral surface of the photosensitive drum 101, is conveyed through a sheet conveyance guide 109, and is introduced into a fixing apparatus A (fixing device) as an image heating device.

The sheet P is subjected by the fixing device A to a process for thermally fixing the toner image on the sheet P to the sheet P. After the transfer of the toner image from the peripheral surface of the photosensitive drum 101 to the sheet P, the peripheral surface of the photosensitive drum 101 is cleared of transfer residual toner, paper dust, and the like contaminants by a cleaning device 110, and then, is used for the formation of the next image. After being conveyed through the fixing device A, the sheet P is discharged onto a delivery tray 112 through a sheet outlet 111.

2. General Description of Fixing Device

Figure 2:
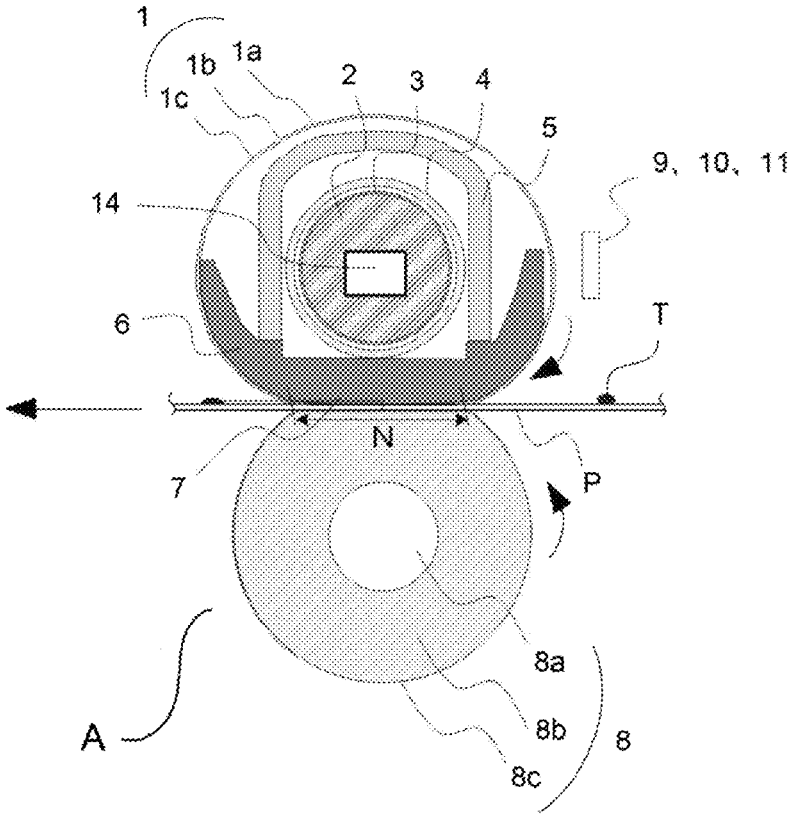
FIG. 2 is a schematic cross-sectional view of the essential portion of a typical fixing device to which the present invention is applicable.
Figure 3:
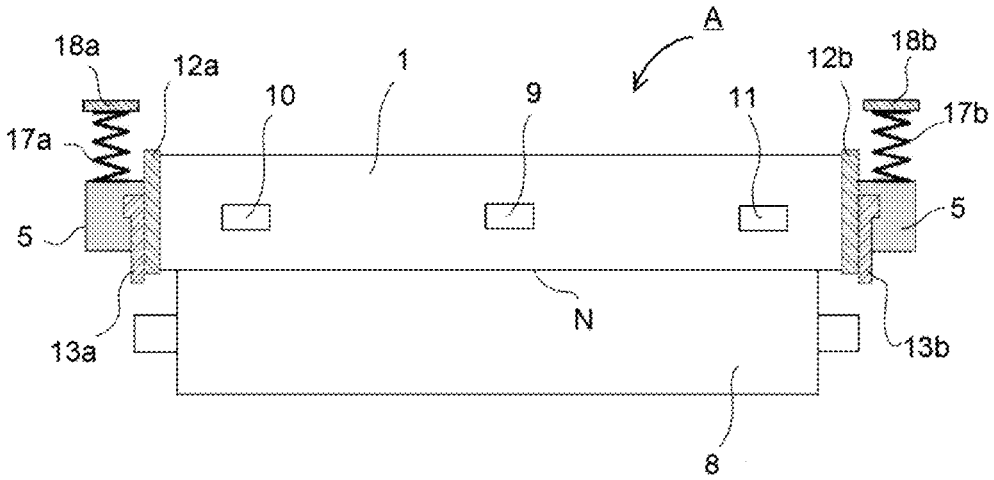
FIG. 3 is a schematic front view of the essential portion of the fixing device in FIG. 2.
Figure 4:
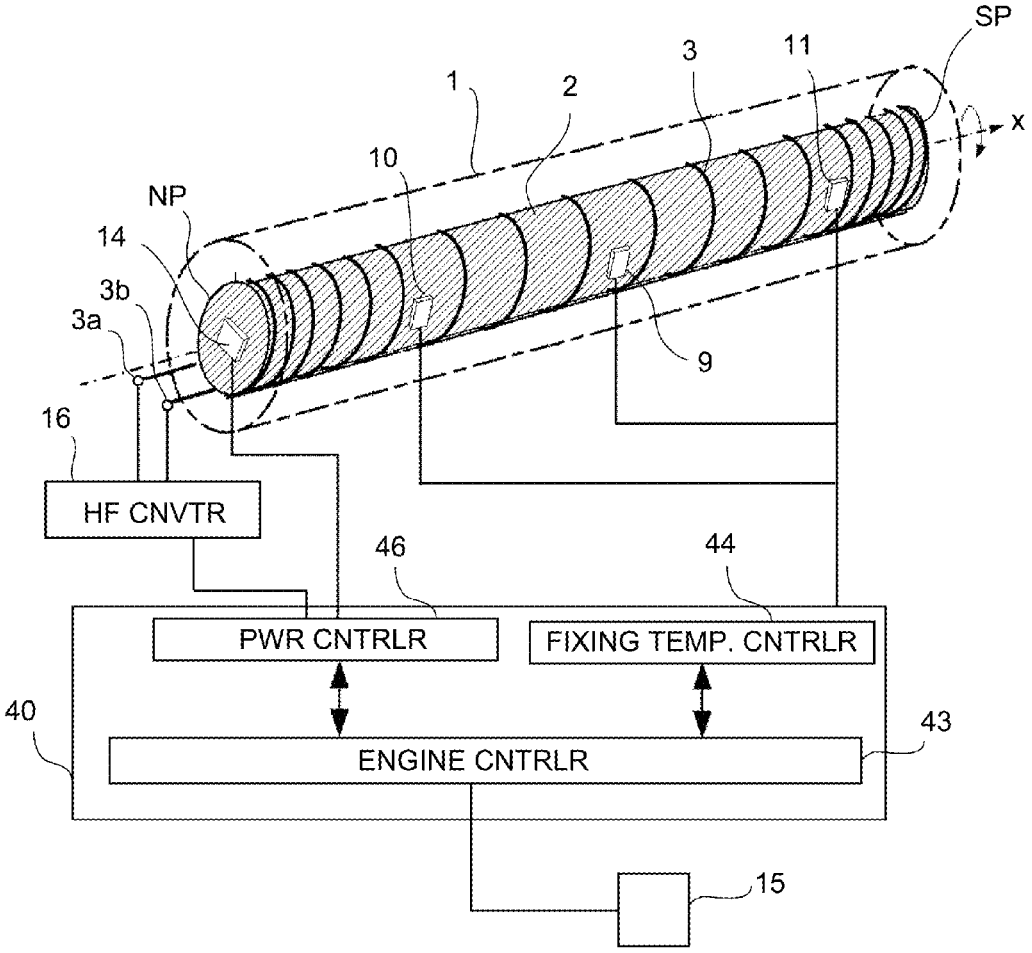
FIG. 4 is a perspective view of the essential portion of the fixing device in FIG. 2.

The fixing device A in this embodiment is a heating device which uses a heating method based on electromagnetic induction. FIG. 2 is a schematic cross-sectional view of the essential portion of the fixing device A. FIG. 3 is a schematic front view of the essential portion of the fixing device A. FIG. 4 is a perspective view of the essential portion of the fixing device A.

A pressure roller 8, which is a pressure applying member (nip forming member) is made up of a metallic core 8*a*, a heat resistant and elastic layer 8*b*, and a release layer 8*c* as a surface layer. The elastic layer 8*b* is formed around the peripheral surface of the metallic core 8*a* in the form of a roller, which is coaxial with the metallic core and covers virtually the entirety of the peripheral surface of the metallic core 8*a*. As the material for the elastic layer 8*b*, such a substance as silicone rubber, fluorine rubber, fluoro-silicone rubber that is excellent in heat resistance is desired. The lengthwise ends of the metallic core 8*a* are rotatably supported by an unshown pair of the lateral plates of the fixing device chassis, with the placement of a pair of electrically conductive bearings between the lengthwise ends and the pair of the lateral plates and, one for one.

Referring to FIG. 3, a pair of compression springs 17*a* and 17*b* are disposed in a compressed state between the lengthwise ends of a pressure application stay 5, and a pair of spring bearing members 18*a* and 18*b*, respectively. Thus, the pressure application stay 5 remains pressured downward. By the way, in the case of the fixing device A in this embodiment, the total amount of pressure to which the pressure application stay 5 is subjected is roughly 100 N-250 N (10 kgf-25 kgf).

Thus, the bottom surface of a sleeve guiding member 6, which is formed of heat resistant resin such as PPS, and the upwardly facing portion of the peripheral surface of the pressure roller 8 are pressed against each other, with the presence of a fixation sleeve 1 therebetween. The sleeve 1 is a cylindrical and rotational member and has an electrically conductive layer, between the sleeve guiding member 6 and pressure roller 8. Thus, a fixation nip N, which has a preset width in terms of the recording medium conveyance direction, is formed between the fixation sleeve 1 and the pressure roller 8.

The pressure roller 8 is rotationally driven in the counterclockwise direction indicated by an arrow mark in the drawing by an unshown driving means. Thus, the fixation sleeve 1 is subjected to the rotational force attributable to the rotation of the pressure roller 8 and the friction between the fixation sleeve 1 and the pressure roller 8. Thus, the fixation sleeve 1 is rotated in the clockwise direction indicated by an arrow mark, with its inward surface sliding on the sleeve guiding member 6 by its inward surface. A sheet P of the recording medium is introduced into the fixation nip N, and is conveyed through the fixation nip N while remaining pinched between the fixation sleeve 1 and the pressure roller 8.

A pair of flanging members 12*a* and 12*b* are fitted around the left and right end portions of the sleeve guide 6, in such a manner that they are allowed to rotate around the sleeve guide 6. In terms of their movement in the left-right direction, they are prevented from moving by a pair of regulating members 13*a* and 13*b*. They play the role of regulating the movement of the fixation sleeve 1 in the direction parallel to the lengthwise direction of the sleeve guide 6, by catching the fixation sleeve 1 by the lengthwise ends of the fixation sleeve 1 when the fixation sleeve 1 rotates. As the maternal for the flanging members 12*a* and 12*b*, such substances as LCP (Liquid Crystal Polymer), which is excellent in heat resistance, is desirable.

Regarding the positioning of the fixing device A, the front side is the side from which a sheet P of the recording medium is introduced into the fixing device A. The left or right side is the left or right side as the fixing device A is seen from the front side.

The fixation sleeve 1 is a cylindrical and rotatable heating member which has a multilayer structure. More concretely, it has: a heat generation layer 1*a* (electrically conductive layer), as a substrative layer, which is formed of an electrically conductive substance; an elastic layer 1*b* layered upon the peripheral surface of the heat generation layer 1*a*; and a release layer 1*c* layered on the outward surface of the elastic layer 1*b*. The smaller the fixation sleeve 1 in diameter, the smaller a heating device can be structured in overall size, and also, the smaller the fixation sleeve 1 in thermal capacity. Thus, the smaller the fixation sleeve 1 in diameter, the faster the speed at which it increases in temperature as it is heated. As the material for the electrically conductive layer 1*a*, austenitic stainless steels, copper, aluminum, or sliver, which is small in permeability, is used.

However, if the fixation sleeve 1 is made excessively small in diameter, it is possible that it will come into contact with such components as an excitation coil 3, which is disposed in the hollow of the fixation sleeve 1, thereby being prevented from smoothly rotating and/or being robbed of heat. Thus, excessively reducing the fixation sleeve 1 in diameter will possibly affect sheet conveyance and/or performance of the fixing device A.

In this embodiment, a magnetic core which was reduced in diameter with the use of the method (which is described later), was employed as the fixation sleeve 1. Thus, it was possible to employ a sleeve which was as small as 30 mm in diameter. The heat generation layer 1*a* is a piece of metallic film which is 10-50 μm in thickness. The elastic layer 1*b* is formed of silicone rubber which is 20 degrees in hardness (JIS-A, application of 1 kg of weight). It is 0.1 mm-0.3 mm in thickness. The elastic layer 1*b* is covered with the surface layer 1*c* (release layer), which is a piece of tube made of fluorine resin and is 10 μm-50 μm in thickness.

The heat generation layer 1*a* is subjected to alternating magnetic flux to induce electric current in the heat generation layer 1*a*, so that heat is generated in the heat generation layer 1*a*. The thus generated heat is conducted to the elastic layer 1*b* and the release layer 1*c*, heating thereby the entirety of the fixation sleeve 1, and heating a sheet P of the recording medium and a toner image T on the sheet P as the sheet P is conveyed through the fixation nip N. Consequently, the toner image T is fixed to the sheet P.

Next, the system which induces electric current in the heat generation layer 1*a* by subjecting the heat generation layer 1*a* to alternating magnetic flux is described in detail. FIG. 4 is a perspective view of the essential portion of the fixing device A. It shows the structure of the fixing device A. The magnetic core 2, which is a magnetic core member, is disposed with the use of an unshown fixing means in such a manner that it is put through the hollow of the fixation sleeve 1. Thus, a linear and open magnetic circuit which has magnetic poles NP and SP is formed. More concretely, the magnetic core 2, the lengthwise direction of which coincides with the direction of the generatrix of the fixation sleeve 1, is put through the hollow of the fixation sleeve 1. The magnetic core 2 is in such a shape that does not form a loop outside the fixation sleeve 1. That is, the magnetic core 2 is in such a shape that has two ends. Thus, it forms an open magnetic circuit, that is, a magnetic circuit, a part of which is missing.

As the material for the magnetic core 2, a ferromagnetic substance which is small in hysteresis loss and high in specific permeability is desirable. That is, a ferromagnetic member which is formed of sintered ferrite, ferrite resin, amorphous metallic alloy, or oxide or metallic alloy, such as Permalloy, which is high in permeability, is desirable as the magnetic core 2.

In this embodiment, a magnetic core made, by sintering, of ferrite, which is 1800 in specific permeability, is used as the magnetic core 2. It is cylindrical, and is 240 mm in length. In this embodiment, it was possible to employ a magnetic member which is as small as 120 $mm^2$ in cross-sectional size at a plane perpendicular to the direction X in FIG. 4 (a direction parallel to the rotational axis, or generatrix, of fixation sleeve 1) as the magnetic core 2.

The excitation coil 3, which is placed in the hollow of the fixation sleeve 1, is formed by spirally winding ordinary electrically conductive wire around the magnetic core 2. That is, the excitation coil 3 is wound around the peripheral surface of the magnetic core 2, directly or with the placement of a bobbin or the like between the excitation coil 3 and the magnetic core 2, in the direction perpendicular to the above-mentioned generatrix of the magnetic core 2. Therefore, as high frequency electric current (alternating electric current) is caused to flow through the excitation coil 3 by way of a pair of power supply contacts 3*a* and 3*b* with the use of a high frequency converter 16, or the like, magnetic flux, which is parallel to the direction of the generatrix of the fixation sleeve 1, is generated.

Next, the principle based on which heat is generated in the fixation sleeve 1 of the fixing device A is described. Referring to part (a) of FIG. 11, the fixing device A in this embodiment is configured so that as magnetic flux comes out of one end of the magnetic core 2, it returns to the other end of the magnetic core 2 by no less than 70%, preferably, 90%, through the outward adjacencies of the electrically conductive layer 1*a*. That is, the fixing device A is structured so that the combination of the electrically conductive layer 1*a* and the coil 3 has a high coupling coefficient. Next, referring to part (b) of FIG. 11, the electrically conductive layer 1*a* is heated by the Joule's heat generated by an electric current J which flows through the electrically conductive layer 1*a* in the direction perpendicular to the circumference of the fixation sleeve 1. In other words, the electrically conductive layer 1*a* is made to generate heat by the electrical current J, which is generated by the magnetic flux, the direction of which is parallel to the generatrix of the fixation sleeve 1. That is, the electrically conductive layer 1*a* is made to generate heat, primarily by the electric current J which flows in the direction which is parallel to the circumferential direction of the electrically conductive layer 1*a*.

3. Temperature Control of Fixing Device

Next, referring to FIG. 4, the method (electric power controlling method) for controlling the fixing device A in temperature is described. A reference numeral 40 stands for a control circuit (controlling section). Each of temperature detection elements 9, 10, and 11 is a thermistor of the so-called non-contact type. It detects the temperature of the fixation sleeve 1 (a section for obtaining the fixation sleeve temperature). The signals (electrical signals related to the detected temperature) from the temperature detection elements 9, 10 and 11 are compared with the signal values which correspond to preset target temperature levels, by the engine controlling section (setting section) 43 of the control circuit 40. Based on the results of the comparison, the engine controlling section 43 of the control circuit 40 determines the amount of electric power to be inputted into the high frequency converter 16. The electric power controlling section 46 of the control circuit 40 supplies the high frequency converter 16 with electric power by the determined amount.

Further, the magnetic core 2 is in contact with a temperature detection element 14, which is a temperature obtaining section for detecting (obtaining) the temperature of the magnetic core 2. The information about the temperature detected by the temperature detection element 14 is inputted into the engine control section 43, which sets the maximum amount for the magnetic flux, according to the results (the obtained temperature levels). Setting of the maximum amount for the magnetic flux is described later in detail.

4. Method for Setting Maximum Amount for Magnetic Flux

Figure 5:
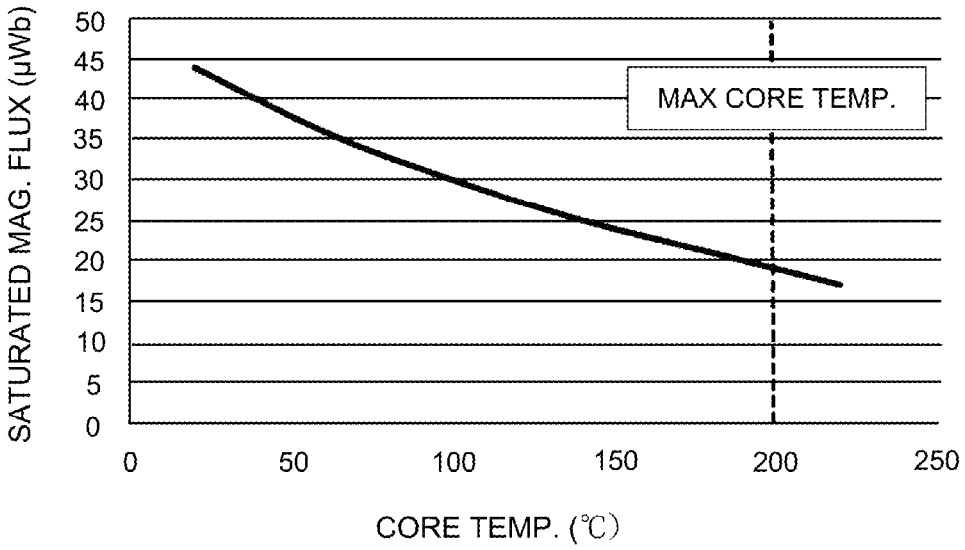
FIG. 5 is a drawing which shows the relationship between the saturation magnetic flux and core temperature, in the first embodiment of the present invention.

FIG. 5 is a drawing which shows the relationship between the amount of the magnetic flux in the magnetic core 2, and the temperature of the magnetic core 2, when the magnetic core 2 is saturated with the magnetic flux. The higher temperature of the magnetic core 2, the smaller the amount of saturation magnetic flux of the magnetic core 2. Moreover, in the case of the image forming apparatus in this embodiment, the temperature of the magnetic core 2 becomes highest when the image forming apparatus is continuously used for a substantial length of time to continuously output a substantial number of prints. More specifically, it reached the highest level as the image forming apparatus was operated to continuously output a substantial number of prints for roughly 60 minutes. The high level of the temperature was in a range of 190° C.-200° C.

Figure 6:
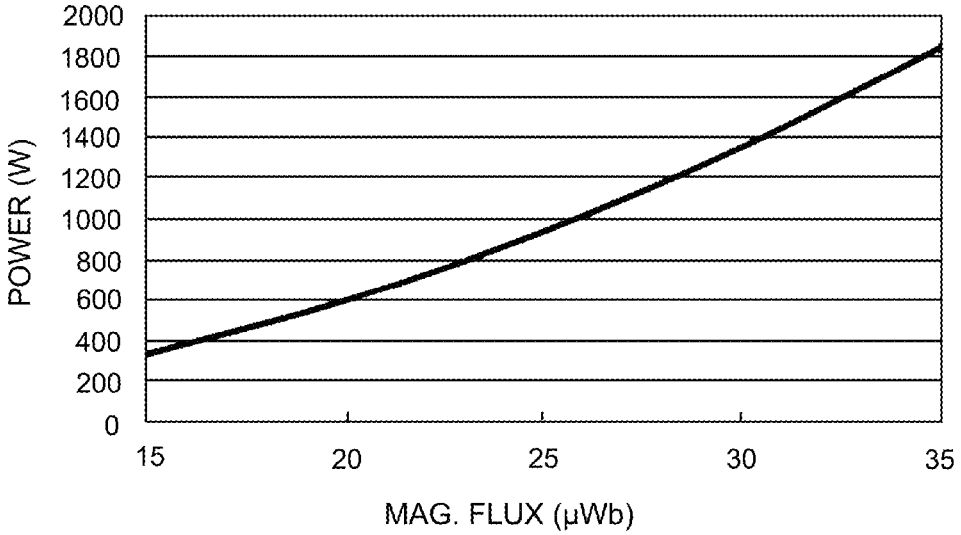
FIG. 6 is a drawing which shows the relationship between the amount of electric power consumption and the magnetic flux.
Figure 7:
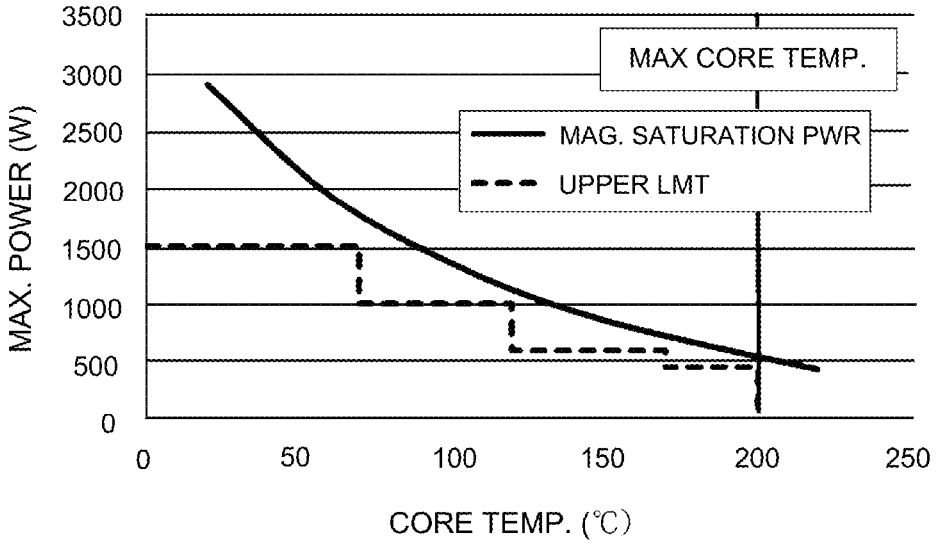
FIG. 7 is a drawing which shows the relationship between the maximum allowable amount of electric power consumption and the core temperature.

In this embodiment, therefore, in order to prevent the magnetic core 2 from being saturated with the magnetic flux, the maximum amount is set for the magnetic flux which the excitation coil 3 is made to generate, according to the temperature of the magnetic core 2. Referring to FIG. 6, the maximum amount for the magnetic flux is set by converting the magnetic flux density into an equivalent amount of electric power, and then, the largest amount of electric power supplied to the excitation coil 3 is set to the value of this equivalent amount of electric power. Setting the maximum amount of electric power supplied to the excitation coil 3 controls (limits) the maximum amount of electric power allowed to be supplied to the excitation coil 3. It is possible to obtain the relationship between the magnetic core temperature and the maximum amount by which the excitation coil 3 is allowed to be supplied with electric power without causing the magnetic core 2 to be saturated with magnetic flux, from FIGS. 5 and 6. This relation is shown in FIG. 7, in which a solid line represents the relationship between the core temperature and the maximum amount of electric power that can be supplied to the excitation coil 3 without saturating the excitation coil 3 with magnetic flux. In this embodiment, however, the maximum amount of electric power is set according to the magnetic core temperature as shown by a broken line in FIG. 7.

5. Verification of Effects

In this embodiment, the largest amount of electric power allowed to be supplied to the excitation coil 3 was set as shown in Table 1. Then, the length of time it took for the temperature of the fixation sleeve 1 to reach the level (target level) at which the fixing device A became ready for image fixation after electric power began to be supplied to the excitation coil 3 when the magnetic core temperature was 25° C., 100° C., 150° C. and 180° C., was measured.

First example of comparative control: the maximum amount of electric power was set to 450 W regardless of the temperature of the magnetic core 2. Also in the case of this setting, the length of time it took for the fixation sleeve 1 to reach the fixation-possible-temperature was measured.

Second example of comparative control: in order to prevent the magnetic core 2 from being saturated with the magnetic flux, even if the excitation coil 3 is supplied with 1500 W of electric power when the magnetic core temperature was 200° C., the magnetic core 2 was made to 250 $mm^2$ in the size of its cross-section. Accordingly, the fixation sleeve 1 was increased in internal diameter to 40 mm. Also in the case of the comparative control, the length of time it took for the temperature of the fixation sleeve 1 to reach the fixation-possible-level was measured.

The results of the verification tests are shown in Table 2. In this embodiment, the target length of time for the temperature of the fixation sleeve 1 to reach the fixation-possible-level was set to be no more than 7.5 seconds.

TABLE 1

| | | Core temp. | | | |
|---|---|---|---|---|---|
| | | −70° C. | 71-120° C. | 121-1700° C. | 171-200° C. |
| Upper limit of electric power | Embodiment | 1500 W | 1000 W | 600 W | 450 W |
| | Comp. Ex. 1 | 450 W | 450 W | 450 W | 450 W |
| | Comp. Ex. 2 | 1500 W | 1500 W | 1500 W | 1500 W |

TABLE 2

| | | Core temp. | | | |
|---|---|---|---|---|---|
| | | 25° C. | 100° C. | 150° C. | 180° C. |
| Upper limit of electric power | Embodiment | 7.0 sec | 6.8 sec | 7.0 sec | 7.3 sec |
| | Comp. Ex. 1 | 15.2 sec | 11.8 sec | 8.1 sec | 7.3 sec |
| | Comp. Ex. 2 | 8.2 sec | 7.1 sec | 6.1 sec | 5.4 sec |

In this embodiment, in a case where the magnetic core temperature is high, the maximum amount for the electric power is limited to a small value. That is, the engine controlling section 43 (setting section) sets the maximum amount of electric power in such a manner that the higher the magnetic core temperature (obtained temperature), the smaller the maximum amount of electric power. However, because the fixing device itself may have warmed up, it does not require a large amount of heat to make the fixation sleeve 1 reach the fixation-possible-temperature. Therefore, even if the maximum amount of electric power is small, it is possible to make the fixation sleeve 1 reach the fixation-possible-temperature in a short length of time. On the other hand, in a case where the magnetic core temperature is low, the maximum amount of electric power may be set to be larger. Therefore, even if the heating device itself has not warmed up, it is possible to make the fixation sleeve 1 reach the fixation-possible-temperature within a short length of time.

In comparison, in the case of the first example of comparative control, as long as the magnetic core temperature was high, it was possible to make the fixation sleeve 1 reach the fixation-possible-temperature within a target length of time, as it was in the case of this embodiment. However, if the magnetic core temperature was low, it was impossible to make the fixation sleeve 1 reach the fixation-possible-temperature within the target length of time, because the amount of electric power allowed to be supplied to the excitation coil 3 was limited to the same value as the value for a case in which the magnetic core temperature is high.

In the case of the second example of comparative control, the amount of electric power supplied to the excitation coil 3 was kept at 1500 W, regardless of the magnetic core temperature. However, because the fixation sleeve 1 was increased in internal diameter, it was greater in thermal capacity. Therefore, in a case where the magnetic core temperature was high, it was possible to make the fixation sleeve 1 reach the fixation-possible-temperature within the target length of time. On the other hand, in a case where the magnetic core temperature was low, it was impossible to make the fixation sleeve 1 reach the fixation-possible-temperature.

As described above, by providing the fixing device A with a means for detecting the temperature of its magnetic core 2, and adjusting the maximum amount of magnetic flux allowed to be generated by the excitation coil 3, according to the magnetic core temperature, it was possible to make the fixation sleeve 1 reach the fixation-possible-temperature within a short length of time, even when the magnetic core 2 was reduced in size.

By the way, the method for limiting the maximum amount of electric power supplied to the excitation coil 3 does not need to be limited to the one in this embodiment, which changes the amount in steps according to the magnetic core temperature. For example, such a method that changes the maximum amount in a step-less manner according to the magnetic core temperature may be employed.

[Embodiment 2]

Next, the second embodiment of the present invention is described. In the first embodiment, the temperature obtaining section for obtaining the temperature of the magnetic core 2 was the temperature detection element 14, with which the magnetic core 2 was provided. However, the temperature obtaining section for obtaining the temperature of the magnetic core 2 does not need to be limited to the temperature detection element 14. For example, it may be such a means (temperature estimating means) that is for estimating (predicting) the magnetic core temperature. In the second embodiment, such a means was employed as the temperature obtaining section.

In the second embodiment, the magnetic core temperature is estimated based on the temperature detection history of the temperature detection elements 9, 10 and 11, and the printing operation history of the image forming apparatus 100. That is, the temperature obtaining section which obtains the temperature of the magnetic core 2 comprises: the temperature detection elements 9, 10 and 11, which detect the temperature of the fixation sleeve 1; and a temperature estimating section 43 (engine controlling section) which estimates the temperature of the magnetic core 2 based on the temperature detected by these temperature detection elements 9, 10 and 11.

Figure 8:
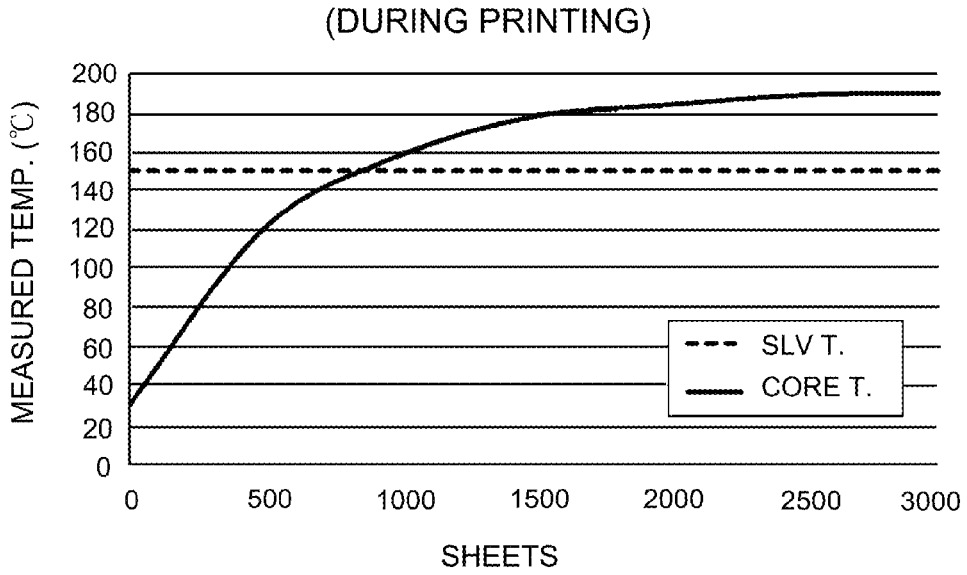
FIG. 8 is a drawing which shows the relationship among the measured sleeve temperature, measured core temperature, and the print count.
Figure 9:
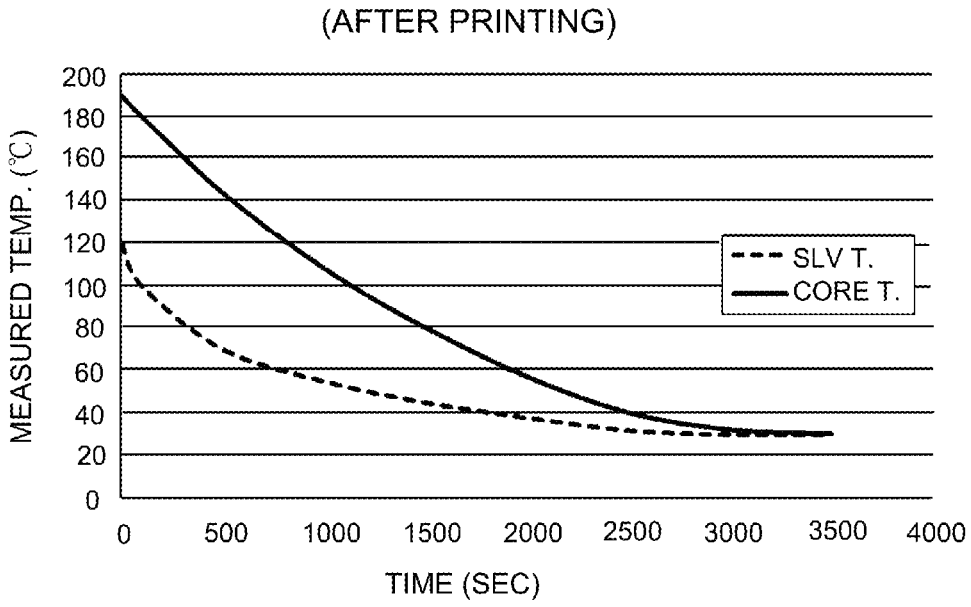
FIG. 9 is a drawing which shows the relationship among the measured sleeve temperature, the measured core temperature, and the length of elapsed time after the completion of a printing operation.
Figure 10:
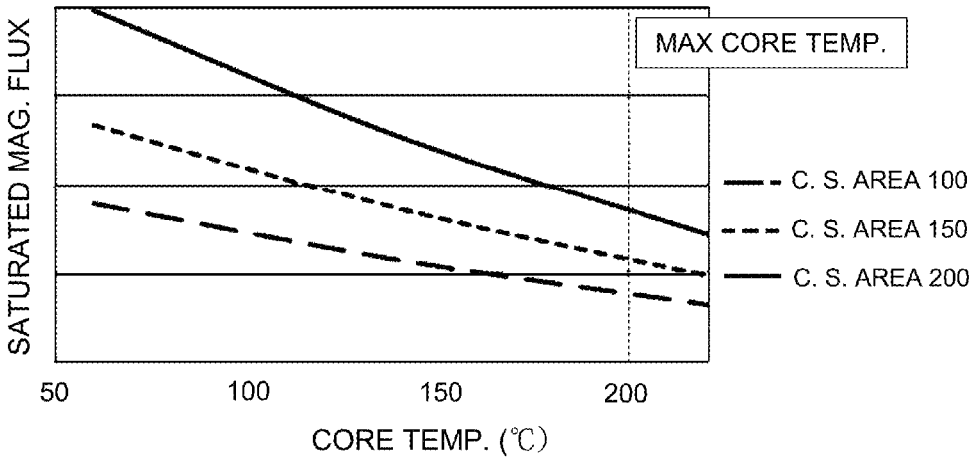
FIG. 10 is a drawing which shows the relationship among the saturation magnetic flux, the core temperature, and the size of the core cross-section.

FIG. 8 shows the relationship among the measured temperature of the fixation sleeve 1, the measured temperature of the magnetic core 2, and the print count, when a substantial number of prints were continuously outputted. As the print count increased, the magnetic core temperature increased. More specifically, as the print count reached roughly 2,500, the magnetic core temperature reached 190° C. In particular, during the initial period of operation which was high in the rate of temperature increase, the magnetic core temperature increased roughly 90° C. while 500 prints were outputted. In other words, the rate of temperature increase was 0.18° C./print. Further, there seems to be virtually no correlation between the fixation sleeve temperature and the magnetic core temperature. Next, FIG. 9 shows the relationship among the measure temperature of the fixation sleeve 1, the measured temperature of the magnetic core 2, and the elapsed length of time since the completion of the printing operation. As time elapsed since the completion of the printing operation, the magnetic core temperature gradually became closer to the fixation sleeve temperature. Further, after the elapse of roughly 3,000 seconds, it became the same as the fixation sleeve temperature.

Based on the results of the above described experiments, the engine controlling section 43 estimates temperature T0, at which the magnetic core temperature will be at the starting of a printing operation, and temperature T1, at which the magnetic core temperature will be during the printing operation, as follows.

$$T1=T0+0.18\times n \text{ (however, if } T1>190^\circ \text{ C., } T1 \text{ is assumed to be } 190^\circ \text{ C.)}$$

$$T0=T2-(T2-Ts)\times t/3000.$$

n: print count

T2: length of time having elapsed since the completion of the preceding job

Ts: fixation sleeve temperature

Table 3 shows the settings for the maximum amount of electric power. In this embodiment, the temperature of the magnetic core was estimated, unlike in the first embodiment. Therefore, the maximum amount of electric power was set to values which were slightly smaller than those in the first embodiment. Then, the length of time it took for the fixation sleeve 1 to reach the fixation-possible-temperature after the magnetic core 2 began to be supplied with electric power was measured when the estimated temperature of the magnetic core 2 was 25° C., 100° C., 150° C. and 180° C.

For comparison, as the first example of comparative control, the maximum amount of electric power was set to 450 W, regardless of the temperature of the magnetic core 2. Then, the length of time it took for the fixation sleeve 1 to reach its fixation-possible-temperature was measured as it was in the tests in which the control in the first embodiment was verified.

Further, as the second example of comparative control, in order to prevent the magnetic core 2 from becoming saturated with magnetic flux even if the excitation coil 3 is supplied with 1,500 W of electric power when the magnetic core temperature is 200° C., the magnetic core 2 was made to be 250 $mm^2$ in the size of its cross-section. Thus, the fixation sleeve 1 was increased in internal diameter to 40 mm. Then, the length of time it took for the fixation sleeve 1 to reach its fixation-possible-temperature was measured.

The results of the tests are shown in Table 3.

TABLE 3

| | | Core temp. | | | |
|---|---|---|---|---|---|
| | | −70° C. | 71-120° C. | 121-1700° C. | 171-200° C. |
| Upper limit of electric power | Embodiment | 1450 W | 950 W | 580 W | 450 W |
| | Comp. Ex. 1 | 450 W | 450 W | 450 W | 450 W |
| | Comp. Ex. 2 | 1500 W | 1500 W | 1500 W | 1500 W |

TABLE 4

| | | Core temp. | | | |
|---|---|---|---|---|---|
| | | 25° C. | 100° C. | 150° C. | 180° C. |
| Upper limit of electric power | Embodiment | 7.3 sec | 7.1 sec | 7.3 sec | 7.3 sec |
| | Comp. Ex. 1 | 15.2 sec | 11.8 sec | 8.1 sec | 7.3 sec |
| | Comp. Ex. 2 | 8.2 sec | 7.1 sec | 6.1 sec | 5.4 sec |

Also in the case of this embodiment, the length of time it took for the fixation sleeve 1 to reach the fixation-possible-temperature was no more than 7.5 seconds, which is the target length of time. In comparison, in the case of the first and second examples of comparative control, when the magnetic core temperature was low, the fixation sleeve 1 did not reach the fixation-possible-temperature within the target length of time.

As described above, in this embodiment, the fixing device A was provided with a temperature estimating section for estimating the magnetic core temperature, and the maximum amount of magnetic flux allowed to be generated by the excitation coil 3 was changed according to the estimated temperature of the magnetic core 2. As a result, even when the magnetic core 2 was reduced in size, it was possible to make the fixation sleeve 1 reach its fixation-possible-temperature within a short length of time.

In this embodiment, the temperature of the magnetic core 2 was estimated by mathematical calculation based on the temperature of the fixation sleeve 1 and the history of the preceding printing operation. However, it may be based on only the history of the preceding printing operation, or the temperature of the fixation sleeve 1, that the temperature of the magnetic core 2 is estimated. That is, the fixing device A was configured so that its temperature obtaining section was the temperature estimating section 43 (engine controlling section) which estimates the temperature of the magnetic core 2 based on the history of the printing operation carried out by the image forming apparatus 100.

Further, in a case where the image forming apparatus 100 is equipped with other temperature detection elements than those in the first embodiment (an element which detects ambient temperature, an element which detects internal temperature), the information obtained from the other temperature detection element can be used to more precisely estimate the temperature of the magnetic core 2. That is, the fixing device A is configured so that the temperature obtaining section is made up of a combination of a temperature detection element 15 (FIG. 4), which detects the ambient temperature of the internal space of the image forming apparatus 100, and the temperature estimating section 43 (engine controlling section), which estimates the temperature of the magnetic core based on the temperature detected by the temperature detection element 15.

Here, a fixing device includes not only a heating device for fixing an unfixed toner image on a sheet of the recording medium to the sheet, but also, a heating device for applying heat and pressure to the temporarily or permanently fixed image on a sheet of the recording medium for the second time to improve the image in glossiness.

Moreover, in the first and second embodiments, the cylindrical and rotational heating member having the electrically conductive layer 1*a* was the flexible fixation sleeve 1. These embodiments, however, are not intended to limit the present invention is scope. For example, the cylindrical, flexible, and the rotational heating member having the electrically conductive layer 1*a* may be a flexible endless belt which is suspended, and kept tensioned, by two or more belt suspending members, and which is rotationally (circularly) driven. Further, it may be a hard and hollow roller, for example, a piece of hollow pipe.

Further, in the first and second embodiments, the fixing device A was configured so that the electrically conductive layer 1*a* is made to generate heat (Joule's heat) by the electric current which flows through the electrically conductive layer 1*a* in the direction parallel to the circumferential direction of the layer 1*a*. However, the present invention is also applicable to a fixing device which is configured so that the electrically conductive layer 1*a* is made to generate heat (Joule's heat) by the eddy current induced in the electrically conductive layer 1*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-148611 filed on Jul. 22, 2014, which is hereby incorporated by reference herein in its entirety.

What is claimed is:

1. A fixing device for fixing an image on a recording material, said fixing device comprising:

a rotatable member having an electroconductive layer;

a helical coil having a helical shaped portion which is provided inside said rotatable member so that a helix axis of said coil extends in a generatrix direction of said rotatable member;

a magnetic member provided inside said helical shaped portion, said magnetic member not forming a loop outside said rotatable member; and a controller configured to control electric power supplied to said coil, wherein said electroconductive layer generates heat by electromagnetic induction caused by magnetic flux produced by an alternating current through said coil to fix the image on the recording material by the heat from said rotatable member, and wherein said controller sets an upper limit of the electric power in such a manner that the higher the temperature of said magnetic member, the smaller the upper limit of the electric power.

2. The fixing device according to claim 1, wherein said electroconductive layer generates heat by induced current by the magnetic flux extending along the generatrix direction.

3. The fixing device according to claim 1, wherein said electroconductive layer generates heat by induced current in a circumferential direction of said electroconductive layer.

4. The fixing device according to claim 1, further comprising a temperature detecting member configured to detect the temperature of said magnetic member, wherein said controller sets the upper limit of electric power in accordance with an output of said temperature detecting member.

5. The fixing device according to claim 1, further comprising a temperature detecting member configured to detect the temperature of said rotatable member, wherein said controller sets the upper limit of the electric power in accordance with an estimated temperature of said magnetic member, which is estimated based on an output of said temperature detecting member.

6. A fixing device for fixing an image on a recording material, said fixing device comprising:

a rotatable member having an electroconductive layer;

a helical coil having a helical shaped portion which is provided inside said rotatable member so that a helix axis of said coil extends in a generatrix direction of said rotatable member;

a magnetic member provided inside the helical shaped portion, said magnetic member not forming a loop outside said rotatable member; and a controller configured to control electric power supplied to said coil, wherein said electroconductive layer generates heat by electromagnetic induction caused by magnetic flux produced by an alternating current through said coil to fix the image on the recording material by the heat from said rotatable member, and wherein said controller sets, when the temperature of said magnetic member exceeds a predetermined temperature, an upper limit of the electric power smaller than when the temperature of said magnetic member does not exceed the predetermined temperature.

7. The fixing device according to claim 6, wherein said electroconductive layer generates heat by induced current by the magnetic flux extending along the generatrix direction.

8. The fixing device according to claim 6, wherein said electroconductive layer generates heat by induced current in a circumferential direction of said electroconductive layer.

9. The fixing device according to claim 6, further comprising a temperature detecting member configured to detect the temperature of said magnetic member, wherein said controller sets the upper limit of the electric power in accordance with an output of said temperature detecting member.

10. The fixing device according to claim 6, further comprising a temperature detecting member configured to detect the temperature of said rotatable member, wherein said controller sets the upper limit of the electric power in accordance with an estimated temperature of said magnetic member which is estimated based on an output of said temperature detecting member.

* * * * *